US006810883B2

(12) United States Patent
Felter et al.

(10) Patent No.: US 6,810,883 B2
(45) Date of Patent: Nov. 2, 2004

(54) ELECTRICALLY HEATED CIGARETTE SMOKING SYSTEM WITH INTERNAL MANIFOLDING FOR PUFF DETECTION

(75) Inventors: John Louis Felter, Chester, VA (US); Robert E. Lee, Richmond, VA (US); Ashok Solanky, Mechanicsville, VA (US); Clint Blake, Mechanicsville, VA (US); Pamela Davis, Glen Allen, VA (US); David E. Sharpe, Chesterfield, VA (US); Mark E. Watson, Mechanicsville, VA (US); Robert L. Ripley, Midlothian, VA (US); Brett W. Stevenson, Richmond, VA (US); William J. Crowe, Chester, VA (US)

(73) Assignee: Philip Morris USA Inc., New York, NY (US)

( * ) Notice: Subject to any disclaimer, the term of this patent is extended or adjusted under 35 U.S.C. 154(b) by 38 days.

(21) Appl. No.: 10/290,402

(22) Filed: Nov. 8, 2002

(65) Prior Publication Data

US 2004/0089314 A1 May 13, 2004

(51) Int. Cl.[7] ..... A24F 13/04
(52) U.S. Cl. ..... 131/194; 131/328; 131/329
(58) Field of Search ..... 131/194, 329, 131/328; 128/202.21

(56) References Cited

U.S. PATENT DOCUMENTS

| | | | |
|---|---|---|---|
| 5,060,671 | A | 10/1991 | Counts et al. |
| 5,179,966 | A | 1/1993 | Losee et al. |
| 5,269,327 | A | 12/1993 | Counts et al. |
| 5,388,594 | A | 2/1995 | Counts et al. |
| 5,479,948 | A | 1/1996 | Counts et al. |
| 5,649,554 | A | 7/1997 | Sprinkel et al. |
| 5,726,480 | A | 3/1998 | Pister |
| 5,878,752 | A | 3/1999 | Adams et al. |
| 5,883,310 | A | 3/1999 | Ho et al. |
| 5,934,289 | A | 8/1999 | Watkins et al. |
| 5,954,979 | A | 9/1999 | Counts et al. |
| 5,967,148 | A | 10/1999 | Harris et al. |
| 6,250,149 | B1 | 6/2001 | Black |

OTHER PUBLICATIONS

Notification of Transmittal of the International Search Report or the Declaration for PCT/US03/35616 dated May. 7, 2004.

*Primary Examiner*—Dionne A. Walls
(74) *Attorney, Agent, or Firm*—Burns, Doane, Swecker & Mathis, LLP

(57) ABSTRACT

An electrically heated cigarette smoking device includes a heater unit, heater blades for applying heat to portions of a cigarette that is supported within the heater unit, the heater unit having an opening adapted to receive an end of a cigarette and adapted to position the end of the cigarette in proximity to the heater blades, and the heater unit defining at least part of a suction flow passage through which ambient air is drawn into contact with the cigarette when a smoker draws on the cigarette positioned in the heater unit. The heater unit is mounted within a partition that positions the heater unit relative to the housing and at least partially defines a bypass flow passage in fluid communication with ambient air surrounding the housing, the partition further defining a flow diverting passage leading from the bypass flow passage to the suction flow passage and through which ambient air is drawn from the bypass flow passage when a smoker puffs on a cigarette inserted in the heater unit opening. A flow sensor is positioned in the flow diverting passage to provide a signal indicative of a smoker taking a puff on the cigarette.

9 Claims, 8 Drawing Sheets

ELECTRICALLY HEATED CIGARETTE SMOKING SYSTEM WITH INTERNAL MANIFOLDING FOR PUFF DETECTION

FIELD OF THE INVENTION

The present invention relates to electrical smoking systems that heat a cigarette upon detection of a draw taken on the cigarette.

BACKGROUND OF THE INVENTION

Previously known conventional lit cigarettes deliver flavor and aroma to the user as a result of combustion of tobacco. A mass of combustible material, primarily tobacco, is oxidized as the result of applied heat with typical combustion temperatures in a conventional cigarette being in excess of 800° C during puffing. Heat is drawn through an adjacent mass of tobacco by drawing on the mouth end of the cigarette. During this heating, inefficient oxidization of the combustible material takes place and yields various distillation and pyrolysis products. As these products are drawn through the body of the smoking device toward the mouth of the smoker, they cool and condense to form the aerosol which gives the consumer the flavor and aroma associated with smoking. Conventional lit cigarettes can produce side stream smoke during smoldering between puffs, which may be objectionable to some non-smokers. Also, once lit, conventional cigarettes must be fully consumed or be discarded.

Commonly assigned U.S. Pat. No. 5,388,594, which is incorporated herein by reference, discloses an electrical smoking system that includes novel electrically powered lighters and novel cigarettes that are adapted to cooperate with the lighters. The lighter includes a plurality of metallic heaters disposed in a configuration that slidingly receives a tobacco rod portion of the cigarette. One of the many advantages of such a smoking system is the reusability of the lighter for numerous cigarettes. One of the primary goals in an electrical smoking system such as that disclosed in U.S. Pat. No. 5,388,594, is to provide sensations of smoking that are as close as possible to the sensations experienced when smoking a conventional cigarette. Some of these sensations include the resistance-to-draw (RTD) experienced by a smoker taking a puff on the cigarette, and the length of time between when a smoker begins to draw on the cigarette and when the smoker can first detect the flavors and aromas associated with smoking the cigarette.

RTD of traditional cigarettes is the pressure required to force air through the full length of a standard cigarette at the rate of 17.5 ml per second. RTD is usually expressed in inches or millimeters of water. Smokers have certain expectations when drawing upon a traditional cigarette in that too little RTD or too much can detract from smoking enjoyment. More traditional cigarettes of moderate delivery have RTD's generally within the range of approximately 100 to 130 mm's water.

Establishing a desired RTD in electrical smoking systems is complicated by the circumstance that in smoking systems such as shown in U.S. Pat. Nos. 5,388,594 and 5,692,525, air is first drawn through passages within the cigarette lighter before being drawn out through the cigarette. The filter tipping of the cigarettes of those systems are preferably flow-through and/or low particulate efficiency filters so as to minimize loss of whatever smoke is produced. Such filters produce little pressure drop and therefore do not contribute much RTD. Consequently, prior practices have included the establishment of RTD (or pressure drop) predominantly in the lighter portion of the electrical smoking system, such as with an annular frit (porous body) adjacent the air admission port of the lighter as taught in commonly assigned U.S. Pat. No. 5,954,979, incorporated herein by reference. Because pressure drop varies widely with any change in size of the constriction, it has been found that the frits or other forms of tiny flow constrictions in the lighter body must be manufactured with care. It therefore adds expense and other production and quality concerns. Furthermore, tiny flow passages are prone to clog, particularly in lighters wherein any smoke is allowed to linger after completion of a puff.

Further, establishing a quick response time for electrically heating a portion of the cigarette with one or more heater elements in response to a puff is a desirable characteristic. To achieve an equivalent experience to traditional cigarette smoking, ideally the heating of the cigarette would be instantaneous with the beginning of a puff cycle. However, sensing systems typically have some delay time between the beginning of a puff cycle and the heating of the cigarette with one or more heaters.

The heating fixture in an electrical smoking system such as that shown in commonly assigned U.S. Pat. Nos. 5,388,594 and 5,878,752, which are herein incorporated in their entireties by reference, includes a plurality of radially-spaced heating blades supported to extend from a hub and that are individually energized by a power source under the control of electrical circuitry to heat a number of discrete heating zones around the periphery of an inserted cigarette. Eight heating blades are preferred to develop eight puffs as in a conventional cigarette, although a greater or lesser number of heating blades can be provided.

The electrical circuitry in electrical smoking systems can be energized by a puff sensitive sensor that is sensitive to pressure drops occurring when a smoker draws on the cigarette. The puff sensor activates an appropriate one of the cigarette heater elements or blades as a result of a change in pressure when a smoker draws on the cigarette. A sensor that relies on detection of a pressure drop in order to initiate the smoking event may require a RTD through the cigarette that a smoker finds to be higher than the RTD with a conventional cigarette. The electrical smoking system should preferably provide a RTD that is as close to a conventional cigarette as possible, while also avoiding false signals and undesired actuation of the heater blades that may occur as a result of shock vibration or air flow through the system created by factors other than a smoker drawing on the cigarette, such as movement of the cigarette smoking system or air movement past the cigarette smoking system.

SUMMARY OF THE INVENTION

An embodiment of an electrically heated cigarette smoking device in accordance with the invention includes a heater unit, a plurality of heaters within the heater unit for applying heat to portions of a cigarette supported within the heater unit, the heater unit having an opening adapted to receive an end of a cigarette and adapted to position the end in proximity to the plurality of heaters, and the heater unit defining at least part of a suction flow passage through which ambient air is drawn into contact with the cigarette when a smoker draws on the cigarette positioned in the heater unit. A housing is mated with the heater unit and is designed to be comfortably grasped by a smoker. A partition positions the heater unit relative to the housing and at least partially defines a bypass flow passage in fluid communication with ambient air surrounding the housing, the partition further defining a flow diverting passage through which ambient air is drawn from the bypass flow passage into the suction flow passage when a smoker puffs on a cigarette inserted in the heater unit opening. A sensor can be positioned in the flow diverting passage or in the suction flow passage, and preferably in the flow diverting passage leading to the suction flow passage, to provide a signal indicative of a smoker taking a puff on the cigarette.

In an alternative embodiment, the housing of the electrically heated cigarette smoking device can include a chamber that is formed around at least part of the filter end of the cigarette when the cigarette is inserted into the housing. A vacuum or pressure drop sensor can be ported to the chamber and will consequently sense the vacuum or pressure drop created at this location. Openings in the cigarette at this location allow for the sensing of internal vacuum created within the cigarette when a smoker takes a puff on the cigarette. This arrangement can provide a faster response time than an arrangement wherein RTD (or pressure drop) is established predominantly in the lighter portion of the electrical smoking system, such as with an annular frit (porous body) adjacent the air admission port of the lighter as taught in commonly assigned U.S. Pat. No. 5,954,979.

BRIEF DESCRIPTION OF THE DRAWINGS

Various preferred features and advantages of the invention will become apparent upon the consideration of the following detailed description, taken in conjunction with the accompanying drawings, in which each particular reference number refers to particular parts throughout. In the following figures.

DETAILED DESCRIPTION OF THE PREFERRED EMBODIMENTS

Figure 1:
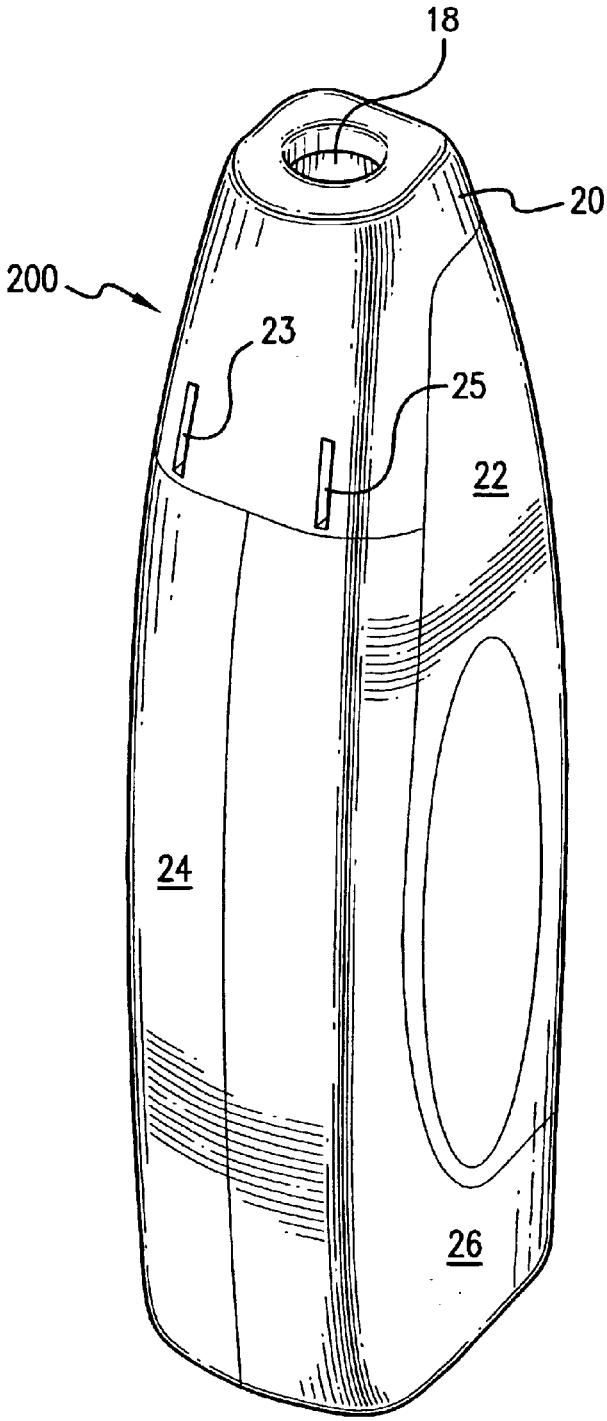
FIG. 1 is a perspective view of an electrically heated cigarette smoking system according to an embodiment of the invention.

An electrically heated cigarette smoking system according to an embodiment of the invention includes a heater unit with heating elements that apply heat to portions of a cigarette supported within the heater unit. The heater unit defines at least part of a suction flow passage through which ambient air is drawn into contact with the cigarette when a smoker draws on the cigarette. A partition positions the heater unit relative to a housing, and at least partially defines a bypass flow passage in fluid communication with ambient air surrounding the housing. The partition further defines a flow diverting passage leading to the suction flow passage through which ambient air is drawn from the bypass flow passage when a smoker puffs on the cigarette.

The provision of a bypass flow passage that is in communication with the surrounding ambient air, and a flow diverting passage leading to a suction flow passage through which air is drawn from the bypass flow passage only when a smoker puffs on a cigarette, ensures that the sensor positioned in the flow diverting passage or the suction flow passage will be activated only when a smoker draws on the cigarette. The arrangement of flow passages within the housing and defined by the housing, the heater unit and a partition that positions the heater unit relative to the housing improves the manufacturability of the electrically heated cigarette smoking device. This arrangement creates a flow passage in which the sensor can be mounted and sufficiently isolated from extraneous flow of ambient air through the device at times other than when a smoker is drawing on the cigarette. The positioning of the sensor in a flow diverting passage or suction flow passage that is accessed only after air has been diverted at least once from a bypass flow passage cuts down on false signals since air will flow through the suction flow passage only when a smoker draws upon the cigarette inserted into the cigarette smoking device. A flow sensor is preferably used in the flow diverting passage since it can detect flow as soon as a smoker begins to draw on the cigarette, thereby enabling a response time that is very similar to the response time a smoker experiences when smoking a conventional cigarette.

An alternative embodiment of an electrically heated cigarette smoking system according to the invention includes a housing, a plurality of heating elements arranged within the housing adapted to receive there-between a portion of a cigarette, a power source that supplies energy to the heating elements to heat the cigarette, and a manifold arrangement defining a puff sensing chamber surrounding a portion of the cigarette at a filter section of the cigarette. The chamber is in fluid communication with the interior of the cigarette through perforations or openings around the filter portion of the cigarette, thereby allowing a pressure sensor positioned in communication with the chamber to detect pressure drops through the cigarette as a smoker takes a puff on the cigarette.

In this alternative embodiment, a separate and distinct puff sensing chamber for an electrically heated cigarette smoking device may be formed to abut a portion of a cigarette. The separate sensing chamber may at one location be directed to abut a particular point or area on the cigarette, or the separate sensing chamber may surround the circumference of the cigarette. The sensing chamber may be at another location vented to, ported to, or occupied by, a pressure sensor switch that detects a change in vacuum in the sensing chamber. The sensing chamber may be attached to the electrically heated cigarette smoking device or built as a separate section or chamber of the electric smoking device. In the case of a cigarette, a portion of the cigarette to which the sensing chamber is to abut may include a number of openings, holes or perforations, so as to allow the change in pressure inside the smokable product that occurs during a puff to be more easily and directly sensed. The openings, holes or perforations may be preformed in the smokable product or may be created by a piercing tool included in the electric smoking device.

The sensing chamber may be affixed to an outer surface of the lighter portion of the electrically heated cigarette smoking system and may include an annular channel that forms a chamber around at least a portion of the circumference of the cigarette. In this case, the channel will be positioned at the filter end of the cigarette when the cigarette is positioned in the lighter portion of the smoking system.

In one variation the sensing chamber may be a round cylinder shape having a central axis oriented parallel to the central axis of the elongated cigarette shaft. The sensing chamber can be formed within a cylindrical manifold arrangement that can be mated with and joined to an end of the lighter such that when a cigarette is inserted through the manifold arrangement and into the lighter, the filter end of the cigarette is surrounded by the sensing chamber defined within the manifold arrangement. The manifold arrangement can also he formed integrally with the lighter. Passageways defined within the manifold arrangement can be designed to direct ambient air surrounding the smoking device or lighter to internal passageways in the lighter that lead to the heater portion of the lighter surrounding the tobacco portion of the cigarette.

In the present state of technology, a vacuum sensing sensor senses the puff vacuum around the tobacco section of the cigarette inside the heater assembly. The heater has a restrictive device in the air inlet path which creates a pressure drop when a smoker takes a puff on the cigarette. In order to make the perceived RTD of the smoking system more like that of a conventional cigarette, the restrictive device is preferably eliminated in this embodiment of the present invention and all of the RTD will be in the cigarette. Consequently there is no pressure drop to sense in the heater chamber.

The manifold arrangement around the filter end of the cigarette directs flow of ambient air essentially unrestricted through the internal passageways to the heater, while providing a separate passageway from the puff sensor (vacuum sensor) to the puff sensing chamber around the filter end of the cigarette. Since there is still vacuum or a pressure drop created in the cigarette, the structure according to this embodiment of the present invention provides for sensing of the pressure drop created in the cigarette near where it is at a maximum. This arrangement makes the lighter respond faster and/or reduces the required sophistication of the vacuum sensor system. This also allows the use of existing vacuum sensing technology.

The sensor used for detecting flow or pressure drop is preferably a micro-electrically machined device that fits within a very small volume, such that the overall size of the cigarette smoking device can be kept small, and the sensor consumes very small amounts of power while providing very fast response times when a smoker draws upon the cigarette, thereby creating a flow or pressure change. The electrically heated cigarette smoking device includes electronics that activate the heater blades upon receiving a signal from the sensor.

Figure 2:
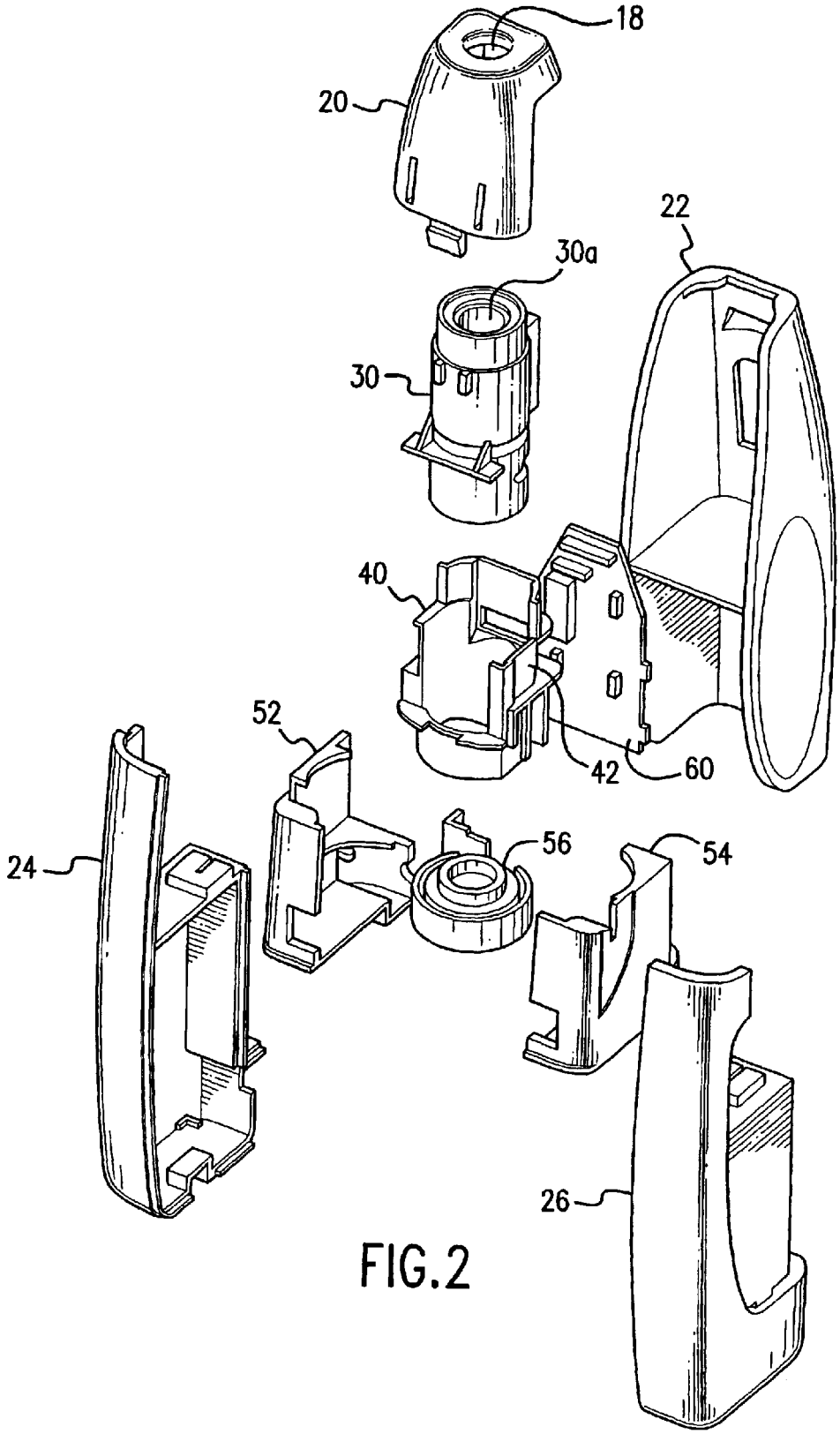
FIG. 2 is an exploded perspective view of the electrically heated cigarette smoking system shown in FIG. 1.

An electrically heated cigarette smoking device 200 according to an embodiment of the invention is shown in an assembled condition in FIG. 1 and in an exploded view in FIG. 2. The entire electrically heated cigarette smoking device 200 includes an upper heater case cap 20, a front housing 22, and left and right battery case portions 26, 24. As shown in the exploded view of FIG. 2, a heater unit 30 is positioned below the heater case cap 20, with the heater unit 30 fitting inside of a partition 40 that positions the heater unit relative to the front housing 22 of the cigarette smoking device. An opening 18 at the top of the heater case cap 20 allows for the insertion of a cigarette into the top opening 30*a* of the heater unit 30. When the cigarette has been inserted through the opening 18 and into opening 30*a* of the heater unit 30, it is positioned in proximity to a plurality of heater blades (not shown) arranged around the circumference of the cigarette. The heater blades are activated in sequence each time a puff is taken on the cigarette and electricity that passes through the heater blades raises the temperature of the blades sufficiently to cause pyrolysis of the tobacco, which is typically contained at least within a layer of the cigarette referred to as the "mat" layer immediately inside of an outer cigarette paper layer, such as shown in commonly assigned U.S. Pat. Nos. 5,388,594, 5,878,752 and 5,934,289, which are herein incorporated in their entireties by reference. The heater blades are in contact with the outer cigarette paper layer, and the heat is sufficient to cause pyrolysis of the tobacco in the mat layer inside of the outer cigarette paper layer, as well as additional tobacco that may be contained within a tobacco plug inside the mat layer.

A printed circuit board 60 is positioned between the partition 40 and the front housing 22, and can include a liquid crystal display that reveals information to a smoker such as the battery charge level and the number of puffs remaining for a cigarette that has been inserted into the heater 30. The printed circuit board 60 can also mount the necessary electronics for activating the heater blades within heater 30 upon receiving a signal from a sensor that can also be mounted on the printed circuit board. Slots 23, 25 through the heater case cap 20, as shown in FIG. 1, provide passageways for ambient air to enter the cigarette smoking device when a cigarette is positioned within the opening 18.

Figure 4:
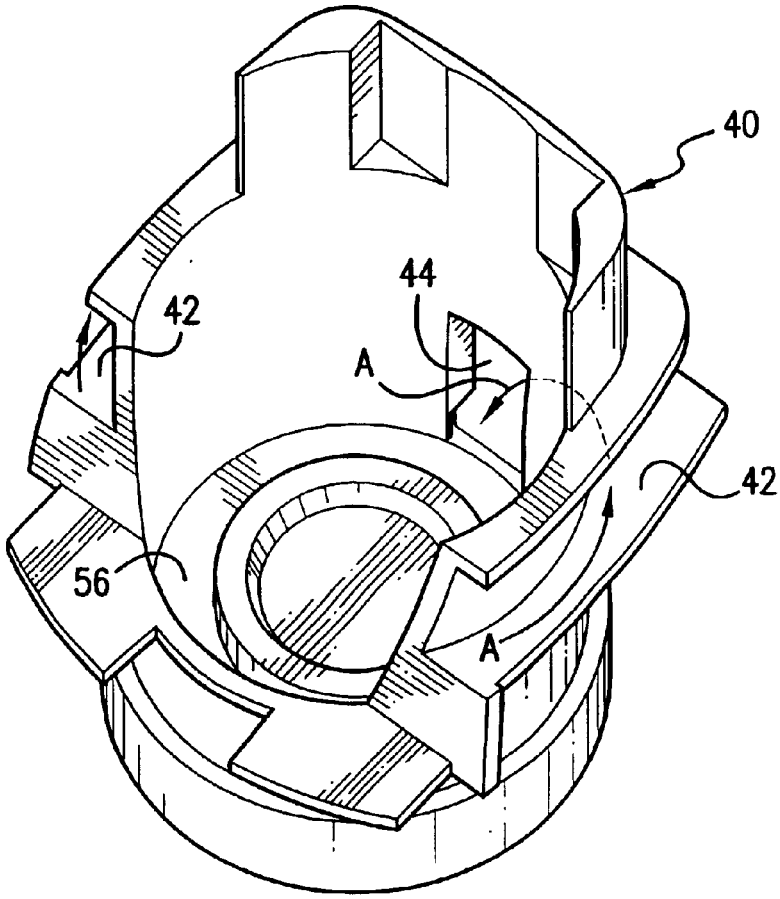
FIG. 4 is a perspective view of a partition and heater unit connector for an electrically heated cigarette smoking system according to an embodiment of the invention.

As best seen in FIG. 2 and the more detailed view of FIG. 4, the partition 40 further defines a circumferential channel 42, or bypass flow passage, that is aligned with the slots 23, 25 when the cigarette smoking device is assembled.

A heater unit connector 56 is positioned below the heater unit 30 within inner housing members 52, 54, and provides an electrical connection between the heater blades mounted within the heater unit 30 and a power source such as a battery (not shown) that is housed within the battery case portions 24, 26. The detailed views in FIGS. 4–7 show the partition 40 mounted on the heater unit connector 56, with the heater 30 that would normally be mounted within the partition 40 not being shown.

The ambient air surrounding the smoking device 200 is free to flow within the bypass flow passage created by the circumferential channel 42 and in and out of the external slots 23, 25, such as when a cigarette is held within the smoking device and the device is moved about but the smoker is not puffing on the cigarette.

Figure 3A:
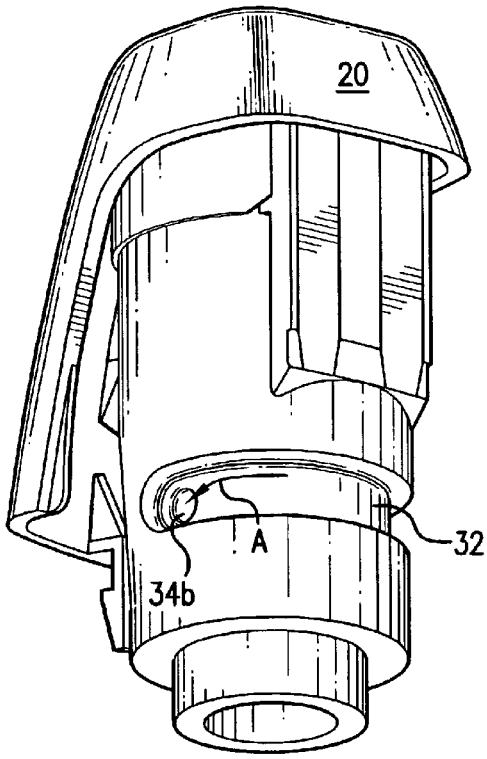
FIGS. 3A and 3B are two perspective views of a heater case cap and heater case for an electrically heated cigarette smoking system according to an embodiment of the invention.
Figure 3B:
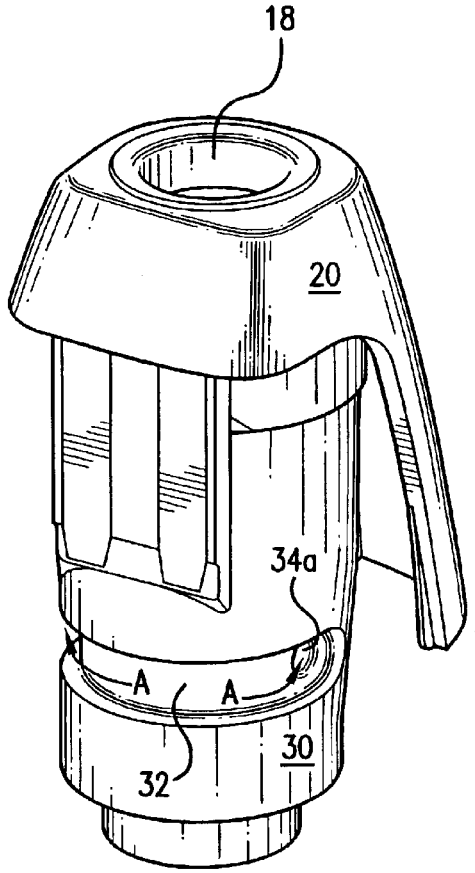
Figure 5:
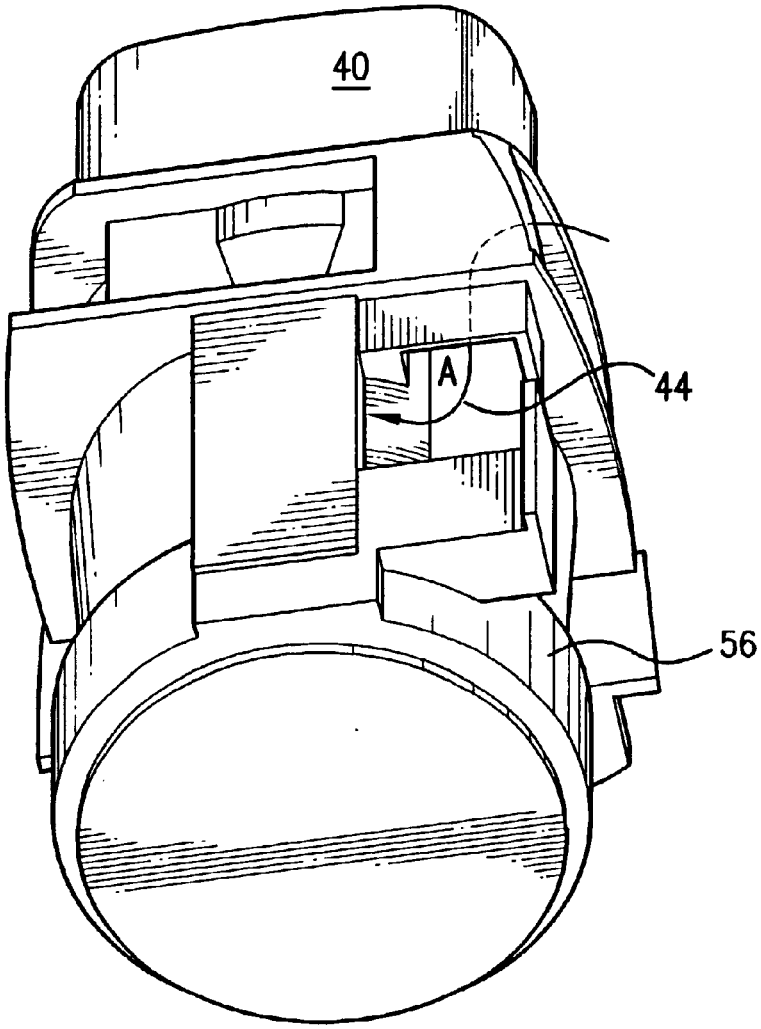
FIG. 5 is another perspective view of the partition and heater unit connector shown in FIG. 4.
Figure 6:
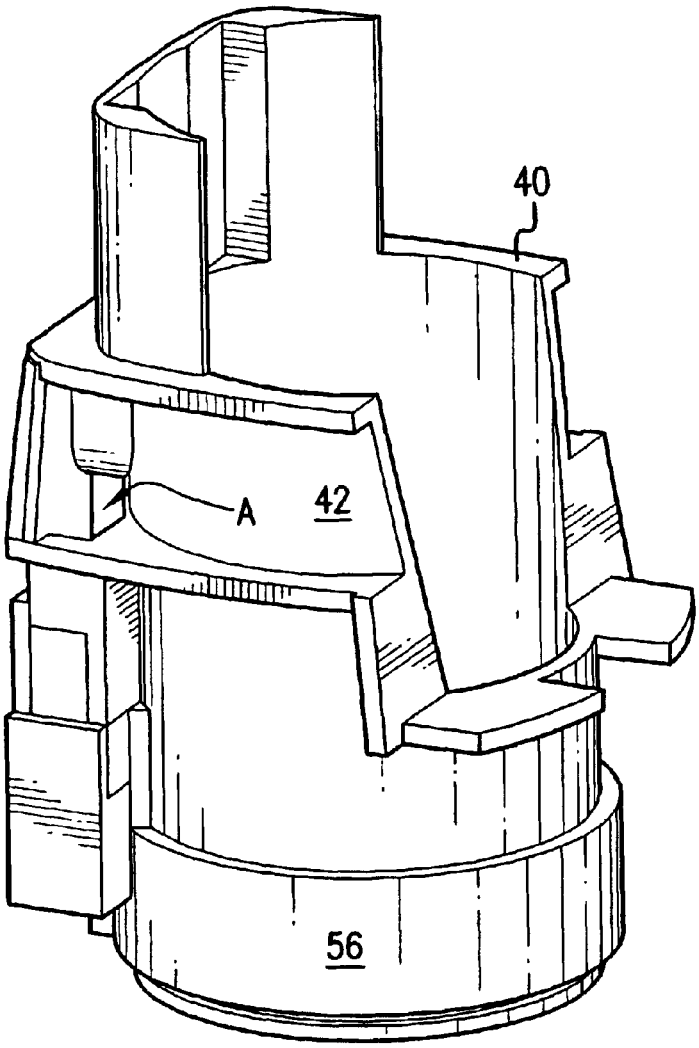
FIG. 6 is yet another perspective view of the partition and heater unit connector shown in FIGS. 4 and 5.
Figure 7:
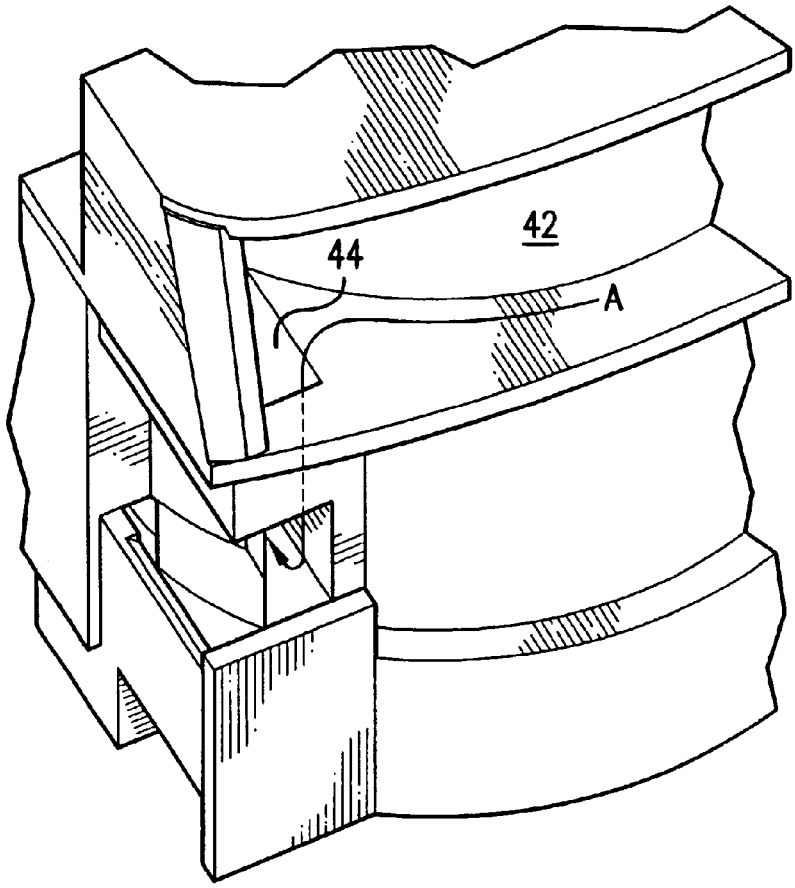
FIG. 7 is an enlarged perspective view of a portion of the partition and heater unit connector shown in FIGS. 4, 5 and 6.

When a cigarette is inserted into the opening 18 of the heater case cap 20 and opening 30*a* of the heater 30, and the smoker draws upon the cigarette, suction is created that pulls the ambient air from the circumferential bypass flow passage 42 into a flow diverting passage 44, which requires the air to change direction from circumferential flow to flow in an axial direction and a radially inward direction, as best seen in FIGS. 4, 5 and 7, with the air flow represented by arrows labeled "A". The pressure drop created by the smoker drawing on the cigarette causes the air to flow from the bypass flow passage 42, into the flow diverting passage 44, and into a suction flow passage 32, seen in FIGS. 3A and 3B, formed by a circumferential groove on the outside of the heater unit 30 and the inner periphery of partition 40. Air sucked into the suction flow passage 32 can pass through radial holes 34*a*, 34*b* at opposite ends of the circumferential groove 32 and into contact with a cigarette placed within the heater 30. The change in direction that air must follow to move from bypass flow passage 42 into the flow diverting passage 44, ensures that air will follow this path only when a suction is created by a smoker drawing upon a cigarette held within the cigarette smoking device. Alternative arrangements for the flow passages through the smoking device can include T-shaped baffles that direct ambient air into contact with the cigarette only when a smoker takes a puff on the cigarette.

A sensor, such as a micro-electrically machined flow sensor, can be placed within the flow diverting passage 44 and mounted to the printed circuit board 60. The sensor is preferably a flow sensor that detects any air flow through the flow diverting passageway 44. An example of a sensor that can be used in the flow diverting passage to detect the occurrence of a puff taken by a smoker is a dual thermal anemometer, which can be manufactured using micro-electrical machining principle techniques. A dual thermal anemometer is based upon the principles of differential voltage, differential current, differential resistance, or differential temperature. The flow of air across such a device generates a difference in the heating of two electrical elements in the device, which in turn creates a difference in voltage, current, resistance, or temperature between the elements. The elements within a dual thermal anemometer can be indirectly heated by the use of a separate heating element that is typically placed in between the sensing elements and in close proximity to those elements. Other flow sensors could include a vane anemometer having a proximity switch that counts the revolutions of the vane and supplies a pulse sequence, which is converted by the measuring instrument to a flow rate. Examples of vane anemometers include paddlewheel-type anemometers, cup anemometers or propellor-type anemometers. Flow sensors that, are manufactured using micro-electrical machining techniques can be made of very small size, which enables a reduction in the size of the overall cigarette smoking device as well as improving the response time of the sensors. A sensor that detects flow, such as a micro-electrically machined anemometer, is preferred since it does not require detection of a pressure difference, and therefore enables the cigarette smoking device to maintain a low resistance to draw when a smoker puffs upon a cigarette mounted within the device. A micro-electrically machined flow sensor also provides a very fast response time such that the time between detection of a puff and the heating of a cigarette mounted within the device is reduced to a level that compares favorably to the sensations experienced by a smoker puffing a conventional cigarette. A micro-electrically machined flow sensor also enables the size of the cigarette smoking device to be reduced since the size of the diverging passageway within which the sensor is mounted can be kept very small.

Another advantage of reducing the length of time between the detection of a puff on the cigarette and the heating of the cigarette mounted within the device is the resulting increase in the length of time during a puff that the tobacco product is being exposed to the heat. Accordingly, for a given length of time that an average smoker will puff upon a cigarette, a greater portion of that time will include the application of heat to the tobacco product and the resultant generation of the aerosols and total particulate matter providing the flavors and aroma desired by the smoker.

In the embodiment shown in the drawings, the suction flow passage 32 leading to the cigarette is reached after air is diverted axially downwardly and radially inwardly through the flow diverting passage 44 from the bypass flow passage 42 formed around the outside of partition 40. One of ordinary skill will recognize that this exact arrangement of flow passages can be varied depending upon the configuration of the various components within the smoking device. The principle requirement is that the passageway within which the flow sensor is mounted is separated from a bypass flow passage in direct communication with the external ambient air by some type of diverging passageway or mechanical baffling that ensures that air will flow only through the suction flow passage when a smoker is drawing upon a cigarette held within the smoking device. As a result of this configuration, false signals that could be created simply by movement of the device are avoided and electronic circuitry necessary to filter out these false signals is no longer necessary.

Figure 8:
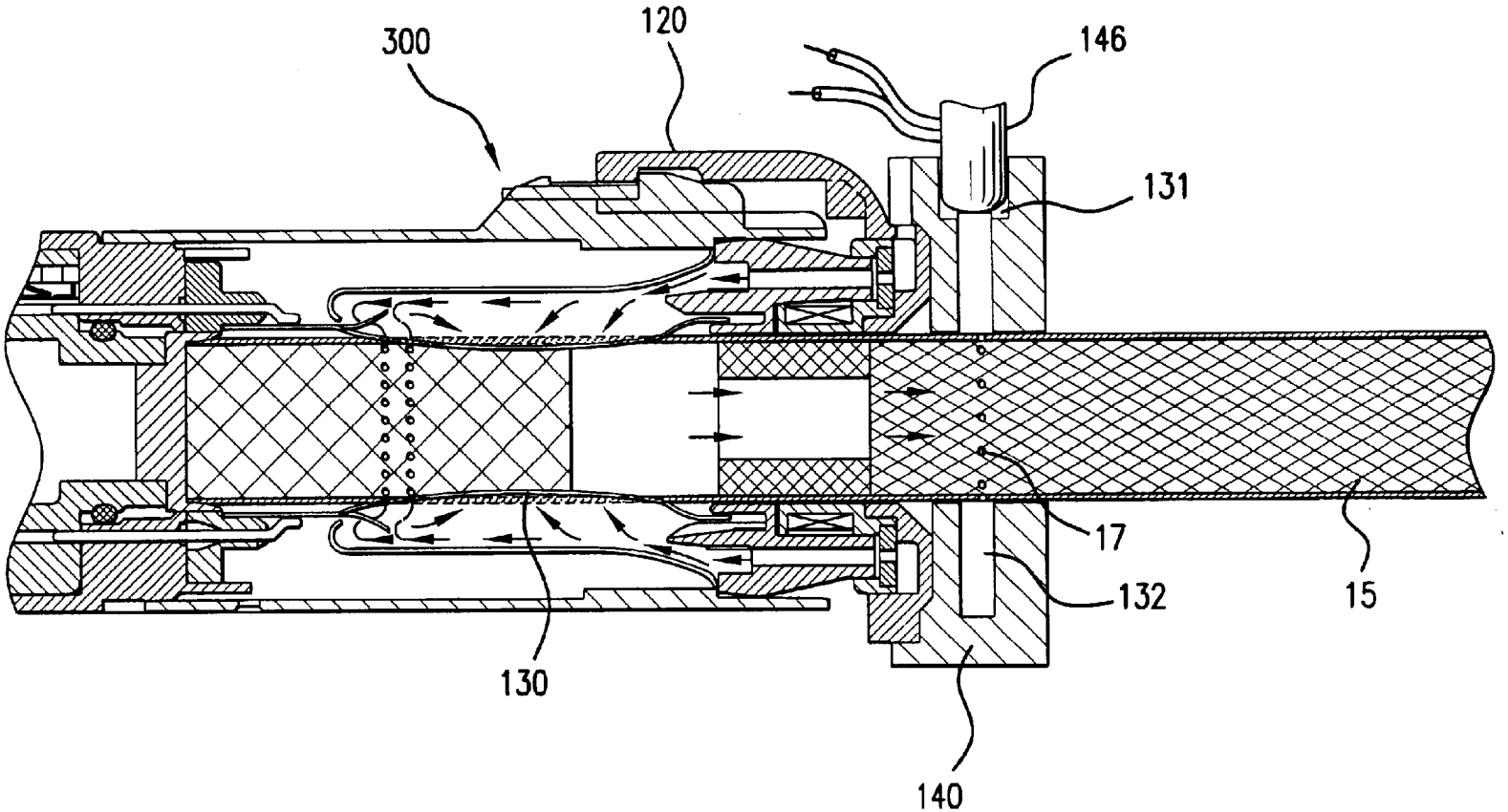
FIG. 8 is a cross-sectional view of an electrically heated cigarette smoking system having a sensing chamber formed around the filter portion of an inserted cigarette.

In an alternative embodiment of an electrically heated cigarette smoking system, partially shown in FIG. 8, a puff sensing chamber 132 may be defined as an annular channel within a manifold 140 having a central axis oriented parallel to the central axis of the cigarette 15. The cylindrical manifold arrangement 140 can be mated with and joined to an end of the lighter 300 such that when a cigarette is inserted through the manifold arrangement 140 and into the lighter 300, the filter end of the cigarette is surrounded by the puff sensing chamber 132 defined within the manifold arrangement 140. The manifold arrangement can also be formed integrally with the lighter.

A portion of the cigarette 15 abutting the puff sensing chamber 132 formed in manifold arrangement 140 may include a number of openings, holes or perforations 17, so as to allow the change in pressure inside the cigarette that occurs during a puff to be more easily and directly sensed. The openings 17 may be preformed in the cigarette 15 or may be created by a piercing tool included in the electric smoking device. The manifold arrangement 140 around the filter end of the cigarette 15 can also include passageways that direct the flow of ambient air essentially unrestricted to internal passageways in the lighter 300 that lead to the heater elements 130 in contact with the cigarette paper wrapping the tobacco portion of the cigarette 15. A separate passageway 131 leads from the puff sensor 146 (vacuum sensor) to the puff sensing chamber 132 around the filter end of the cigarette. Since there is still vacuum created in the cigarette, the structure according to this embodiment of the present invention provides for sensing of the vacuum created in the cigarette near where it is at a maximum. This arrangement makes the lighter respond faster and/or reduces the required sophistication of the vacuum sensor system.

While this invention has been described in conjunctions with the exemplary embodiments outlined above, it is evident that alternatives, modifications and variations will be apparent to those skilled in the art. Accordingly, the exemplary embodiment of the invention as well as variations and modifications may be made without departing from the spirit and scope of the invention as set forth in the attached claims.

What is claimed is:

1. An electrically heated cigarette smoking system, comprising:

a heater unit, said heater unit having an opening adapted to receive an end of a cigarette and said heater unit adapted to apply heat to a portion of said cigarette;

said heater unit defining at least part of a suction flow passage through which ambient air is drawn into contact with the cigarette when a smoker draws on the cigarette positioned in the heater unit;

a housing designed to be grasped by a smoker;

a partition positioning said heater unit relative to said housing and at least partially defining a bypass flow passage in fluid communication with ambient air surrounding said housing, said partition further defining a flow diverting passage leading from said bypass flow passage to the suction flow passage and through which ambient air is drawn from the bypass flow passage when a smoker puffs on a cigarette inserted in said heater unit opening, and a sensor operable to detect air flow in said flow diverting passage and output a signal indicative of a smoker taking a puff on said cigarette.

2. The electrically heated cigarette smoking system according to claim 1, further including electronic circuitry that activates said heater unit upon receiving a signal from said sensor.

3. The electrically heated cigarette smoking system according to claim 2, wherein said sensor is a micro-electrically machined de ice.

4. The electrically heated cigarette smoking system according to claim 3, wherein said sensor is a dual thermal anemometer.

5. The electrically heated cigarette smoking system according to claim 3, wherein said sensor is a vane anemometer.

6. The electrically heated cigarette smoking system according to claim 3, wherein said sensor is a differential pressure sensor.

7. The electrically heated cigarette smoking system according to claim 3, wherein said sensor is a strain sensor.

8. A method of making an electrically heated cigarette smoking system, comprising:

forming a heater unit having an internal opening adapted to receive a portion of a cigarette, the heater unit also having a groove formed around at least part of the outer periphery of the heater unit;

positioning the heater unit relative to an outer housing with a partition between at least part of the heater unit and the outer housing, a first flow passage being defined between the outer housing and the partition, openings being provided through said outer housing into said first flow passage, a second flow passage being defined between the heater unit and the partition, and a flow diverting passage being defined through said partition and connecting said first and second flow passages when said system is assembled; and mounting a flow sensor within said flow diverting passage.

9. The method according to claim 8, wherein:

the heater unit is connected through electronic circuitry mounted within said outer housing to a power source also mounted within said outer housing.

* * * * *